US006186152B1

(12) United States Patent
Gueret

(10) Patent No.: US 6,186,152 B1
(45) Date of Patent: Feb. 13, 2001

(54) MAKEUP BOX HAVING A SEALING MEMBER HELD BY A SUPPORT PIECE

(75) Inventor: Jean-Louis Gueret, Paris (FR)

(73) Assignee: L'Oreal, Paris (FR)

( * ) Notice: Under 35 U.S.C. 154(b), the term of this patent shall be extended for 0 days.

(21) Appl. No.: 09/174,560

(22) Filed: Oct. 19, 1998

(30) Foreign Application Priority Data

Oct. 24, 1997 (FR) ..... 97 13361

(51) Int. Cl.[7] ..... A45D 33/00
(52) U.S. Cl. ..... 132/293; 220/849
(58) Field of Search ..... 132/293, 294, 132/295, 297, 298, 300, 301, 303, 307; 220/806, 795, 849, 815, 812, 811; 215/341, 343, 349

(56) References Cited

U.S. PATENT DOCUMENTS 2,399,997 * 5/1946 Flaster ..... 132/300
2,737,189 * 3/1956 Morningstar et al. ..... 220/849
3,144,167 8/1964 Schultz .
3,841,466 10/1974 Hoffman et al. .
4,862,979 * 9/1989 Borchard ..... 220/815
5,095,657 3/1992 Marsh .
5,186,318 2/1993 Oestreich et al. .
5,353,818 * 10/1994 Suzuki et al. ..... 132/294
5,875,795 * 3/1999 Bouix ..... 132/293

FOREIGN PATENT DOCUMENTS 0 618 387 A1 10/1994 (EP) .
0 790 017 A1 8/1997 (EP) .

* cited by examiner

*Primary Examiner*—Gene Mancene
*Assistant Examiner*—Eduardo C. Robert
(74) *Attorney, Agent, or Firm*—Oliff & Berridge, PLC

(57) ABSTRACT

The invention relates to a makeup box or the like comprising a body housing a supply of substance, a lid, and a sealing member having a deformable lip extending around the supply of substance when the box is closed, one of the lid and the body of the box bearing against said sealing member when the box is closed. The sealing member is secured to a support piece fitted on the other one of the body of the box and the lid, and extending at least in part beneath said deformable sealing lip.

15 Claims, 5 Drawing Sheets

MAKEUP BOX HAVING A SEALING MEMBER HELD BY A SUPPORT PIECE

The present invention relates to a makeup box or the like comprising a body housing a supply of substance, a lid, and a sealing member including a deformable lip which extends around the supply of substance when the box is closed, one of the lid and the body of the box bearing against said sealing member when the box is closed.

BACKGROUND OF THE INVENTION

Numerous boxes of this type are known.

In particular U.S. Pat. Nos. 3,144,167 and 5,186,318 disclose boxes each having a sealing lip integrally formed with a cup containing the supply of substance, said lip extending away from the cup and the body of the box and then being curved at its periphery towards the body of the box so as to bear thereagainst.

There exists a need to further improve the hermetic sealing of makeup boxes in order to prevent solvents contained in the substance from evaporating, but without the means used for obtaining the looked-for sealing spoiling the appearance of the box or making it too expensive to manufacture.

OBJECTS AND SUMMARY OF THE INVENTION

The invention seeks to provide a novel makeup box wherein the sealing member is secured to a support part fixed on the other one of the body of the box and the lid, and extending at least in part beneath said deformable sealing lip.

In a particular embodiment, said support part forms a portion of a cup designed to contain said supply of substance.

In this way, the sealing member can be formed integrally with the cup, thereby simplifying manufacture of the box since the number of separate parts to be assembled is reduced.

Still in a particular embodiment, said support part is in the form of an annular flange.

Preferably, the sealing member is overmolded onto said support part or is made by dual injection with said part.

Also preferably, said support part has openings and said sealing member comprises a top portion and a bottom portion interconnected through said openings, said bottom portion extending beneath said support part and bearing against the body of the box. Advantageously, said bottom portion is annular in shape and bears in sealed manner against the body of the box.

In a particular implementation of the invention, the sealing member has two concentric annular sealing lips suitable for bearing in sealed manner against the lid when the box is closed.

In a particular embodiment, each of said annular sealing lips is generally semicircular in section with the concave side thereof facing towards said support part.

In another particular embodiment, the support part is constituted by an optionally-removable mask fitted to the body of the box. By way of example, the mask can be used to retain in the body of the box a cup containing the supply of substance.

In this embodiment, it is particularly advantageous when the box is closed for the sealing member which is fixed to the mask to be interposed in sealed manner not only between the mask and the lid, but also between the mask and the body of the box so as to prevent the solvents contained in the substance evaporating via the clearance that exists between the mask and the body of the box.

In a particular embodiment, one of the lid and the body of the box has at least one kidney-shaped slot, and the other one of the body and the lid has a hinge pin engaged in said slot, said slot and said hinge pin being organized so that when the lid is closed, the hinge pin can move in said slot so that the lid bears against the sealing member in substantially uniform manner.

BRIEF DESCRIPTION OF THE DRAWINGS

Other characteristics and advantages of the present invention appear on reading the following detailed description of non-limiting embodiments of the invention and on examining the accompanying drawings, in which.

MORE DETAILED DESCRIPTION

Figure 1:
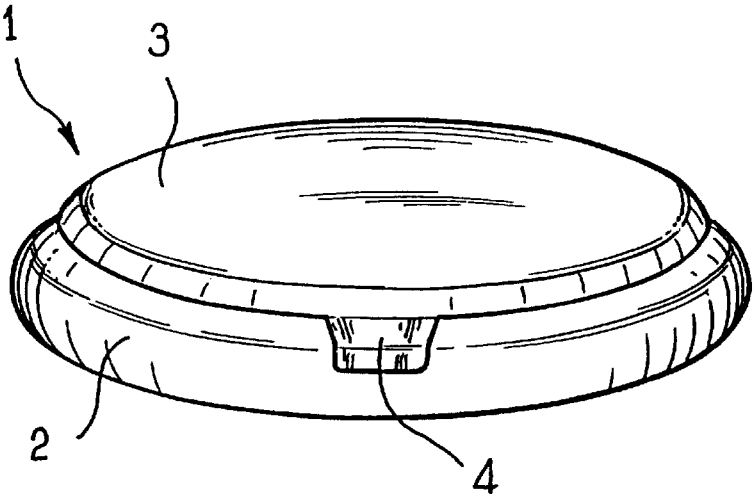
FIG. 1 is a diagrammatic view of a makeup box.
Figure 2:
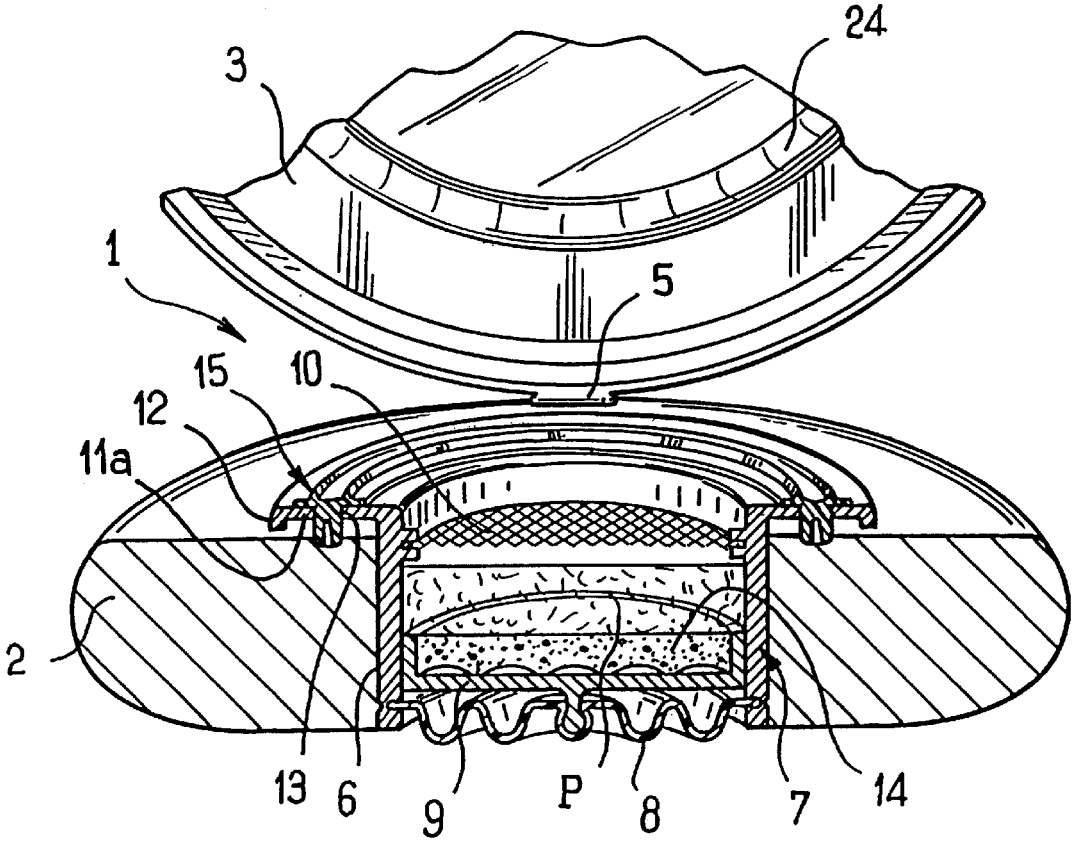
FIG. 2 is a diagrammatic axial section view of the box shown in FIG. 1, with its lid in the open position.

FIGS. 1 and 2 show a makeup box 1 constituting a first embodiment of the invention.

The box 1 comprises a body 2 and a lid 3 hinged to the box 2 by means of a hinge 5 which can be seen in FIG. 2 only.

A clasp 4 is provided opposite the hinge 5 to hold the lid 3 in the closed position.

The body 2 has a central cavity 6 housing a cup 7 containing a supply of substance P, e.g. makeup such as a foundation or a care product.

The underside of the cup 7 is closed by a flexible bottom wall 8, enabling the user to push a piston 9 upwards to dispense the substance P through a screen 10 secured to the top portion of the cup 7.

A foam pad 14 is provided in the piston 9 to ensure the substance P is dispensed uniformly.

The substance may be a powder or a cream, for example.

The cup 7 has a cylindrical wall of relatively rigid plastics material, e.g. of polypropylene or polyethylene, which guides sliding of the piston 9 and which is extended at its top end in a radially outward direction by an annular flange 11*a* which is provided at its periphery with a downwardly-directed rim 12.

Figure 3:
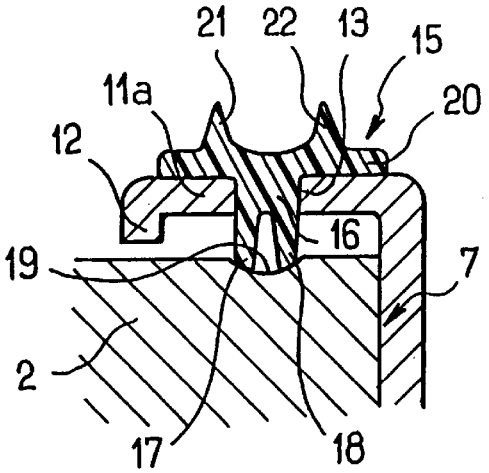
FIGS. 3 and 4 show the sealing member of the box shown in FIGS. 1 and 2 respectively when the box is open and when the box is closed.

In the vocabulary of the present invention, the flange 11*a* constitutes a "support part" and it is pierced by holes 13 angularly distributed around the axis of the cup 7, these holes serving to anchor a sealing member 15 of elastomer material which is described below with reference to FIGS. 3 and 4.

The sealing member 15 comprises a base 20 which covers a large portion of the top face of the annular flange 11*a*, it is extended downwards by bridges of material 16 that pass through the holes 13, and it forms two annular sealing lips 17 and 18 which bear against a shallow annular depression 19 in the top face of the body 2 of the box.

Two concentric annular lips 21 and 22 project upwards from the base 20, these lips being situated substantially on opposite sides of the holes 13.

Figure 4:
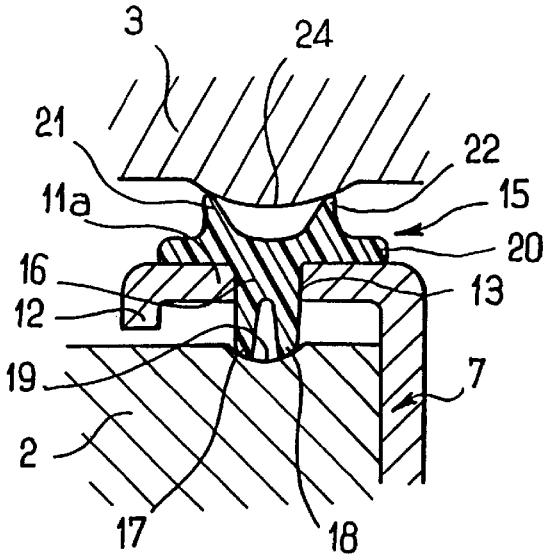

The annular lips 21 and 22 are shaped to come into contact with an annular projection 24 on the lid 3 when the lid is in its closed position, as shown in FIG. 4.

The radius of curvature of the projection 24 is such that the lips 21 and 22 are spread apart slightly on coming into contact therewith.

The sealing member 15 provides two lines of sealing by each of the lips 21 and 22 making contact with the lid, thereby making it very difficult for solvents contained in the substance P to evaporate.

In addition, since the lips 21 and 22 bend little, there is no risk of them losing the memory of their initial shape, even if the box remains closed for a long time.

Finally, although it is made out of relatively rigid plastics material, the flange 11*a* can bend slightly when the box is closed.

Where appropriate, deformation of the flange 11*a* prevents the lips 21 and 22 being subjected to excessive compression force when the lid 3 is closed.

Naturally, the shape of the sealing member is not limited to the embodiment described above.

Figure 5:
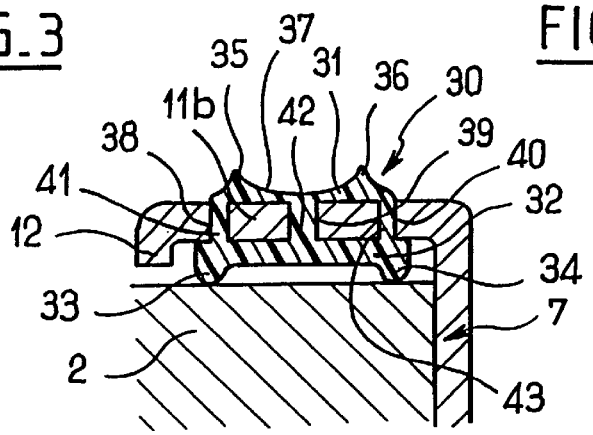
FIG. 5 shows a first variant embodiment of the sealing member.

By way of example, FIG. 5 shows a first variant embodiment of the sealing member, now given reference 30.

The sealing member 30 shown in FIG. 5 has a top portion 31 covering part of the top face of the flange of the cup 7, which flange is now referenced 11*b*, and a bottom portion 32 which extends beneath the flange 11*b* and has two annular lips 33 and 34 bearing against the body 2.

The top portion :31 has two upwardly-directed annular lips 35 and 36 defining a fairly broad groove 37 between them.

The top and bottom portions 31 and 32 are interconnected by a plurality of bridges of material 41, 42, and 43, which bridges pass through holes 38, 39, and 40 formed through the flange 11*b* at different radii and uniformly distributed angularly around the axis of the cup 7.

The bridges of material 42 are connected to the top portion 31 in the bottom of the groove 37. The bridges of material 41 and 43 are situated on either side of the groove 37.

The sealing member 30 is overmolded on the annular flange 11*b*.

The radially outer lip 33 is interposed in sealed manner between the flange 11*b* and the body 2 of the box and serves in particular to prevent dirt accumulating beneath the flange 11*b*.

Figure 6:
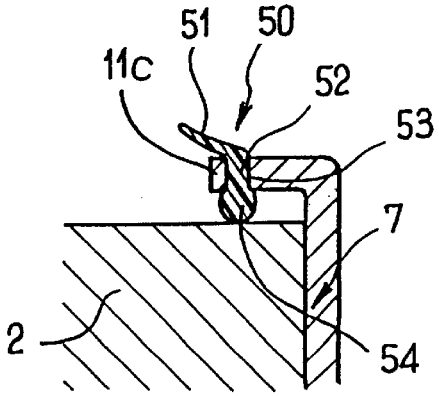
FIGS. 6 and 7 show a second variant embodiment of the sealing member, respectively when the box is open and when the box is closed.
Figure 7:
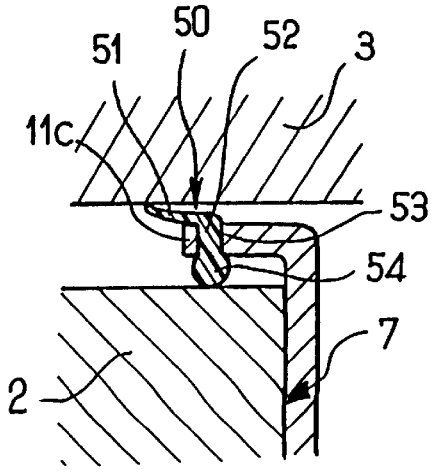

FIGS. 6 and 7 show a second variant embodiment of the sealing member, which is now referenced 50.

The flange of the cup 7 is referenced 11*c* and it differs from the above-described flanges 11*a* and 11*b* by the fact that it is narrower.

The sealing member 50 has an annular lip 51 which extends radially outwards and upwards, being cantilevered out from the flange 11*c*.

This annular lip 51 is extended downwards by bridges of material 52 which pass through holes 53 in the flange 11*c* and which connect to an annular bead 54 which bears in sealed manner against the body 2 of the box.

When the box is closed, the lid 3 presses against the free edge of the lip 51 which bends.

Contact between the lip 51 and the lid takes place over a very narrow annulus, thereby making it possible to obtain high contact pressure, which favors good sealing.

Figure 8:
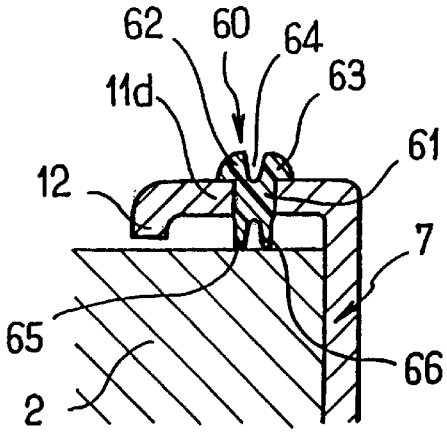
FIGS. 8 and 9 show a third variant embodiment of the sealing member, respectively when the box is open and when the box is closed.
Figure 9:
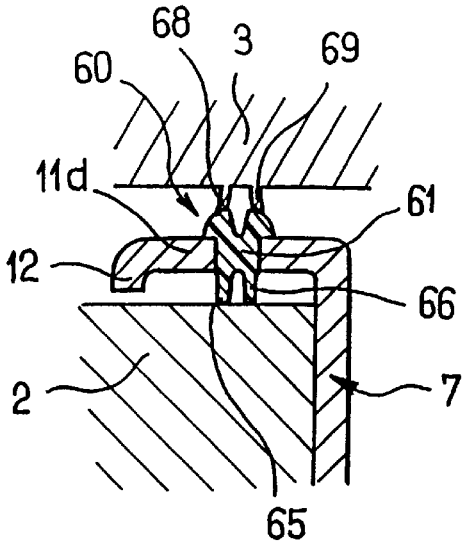

FIGS. 8 and 9 show a sealing member 60 which differs from the sealing member 15 described above with reference to FIGS. 2 and 4 in the shape of the top portion which covers part of the flange of the cup 7, which flange is now referenced 11*d* and is substantially identical to above-described flanges 11*a* and 11*b*.

The sealing member 60 is fixed on the flange 11*d* in substantially the same manner as the above-described sealing member 15.

The top portion of the sealing member 60 has two annular lips or beads 62 and 63 leaving a fairly narrow groove 64 between them.

The top portion of the sealing member is also connected via bridges of material 61 to a bottom portion constituted by concentric lips 65 and 66 resting on the body 2 of the box.

The lid 3 has two concentric annular ribs 68 and 69 projecting down from its inside face and disposed so as to press against the top of the beads 62 and 63 when the box is closed, as shown in FIG. 9.

The beads 68 and 69 flatten slightly on making contact with the ribs 68 and 69, with deformation thereof being made easier by the presence of the grooves 64.

Figure 10:
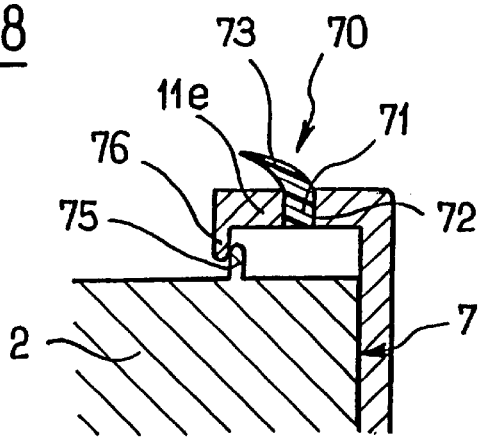
FIG. 10 shows a fourth variant embodiment of the sealing member.

The sealing member 70 shown in FIG. 10 has studs 71 received in holes 72 in the flange now referenced lie. These studs 71 are extended upwards by a flexible lip 73 which tapers and which extends radially outwards.

Unlike the embodiments described above, the sealing member 70 does not extend beneath the flange 11*e* of the cup 7.

Sealing between the body of the box and the lid is obtained, when the box is closed, by the lip 73 bending in a manner analogous to that described with reference to FIGS. 6 and 7.

To prevent impurities reaching the space situated beneath the flange 11*e*, an annular rib 75 is formed on the body 2 and a rim 76 projects down from the periphery of the flange 11*e* to come into contact with the radially outer face of the rib 75.

Figure 11:
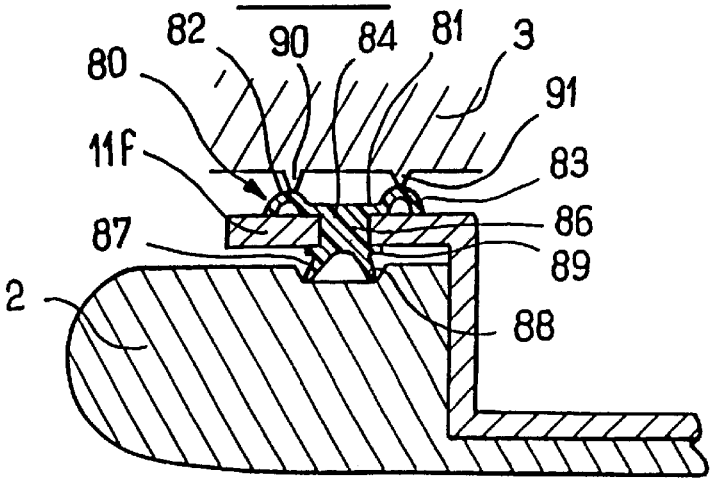
FIG. 11 shows a fifth variant embodiment of the sealing member when the lid is in its closed position.

FIG. 11 shows a sealing member 80 constituting another embodiment of the invention.

In this embodiment, the flange of the cup, now referenced 11*f*, is entirely flat.

The cup 7 having a flexible bottom, as described with reference to FIG. 2 is replaced in this embodiment by a cup having a rigid bottom.

In this case, the user takes the substance without having to press in the bottom of the cup, and there is no need to provide the user with access to the bottom of the cup from outside the box.

The sealing member 80 has a top portion 81 with two lips 82 and 83 bearing against the flange 11*f*, and each having a semicircular section with its concave side facing towards the flange 11*f*.

The lips 82 and 83 are connected to a flat central portion 84.

The central portion 84 is extended downwards by a few bridges of material 86 passing through holes in the flange 11*f*.

The bottom ends of the bridges of material 86 are connected to two concentric annular lips 87 and 88.

A shoulder 89 may also be formed at the bases of the lips 87 and 88, as shown, so as to bear against the bottom face of the flange 11*f* and improve retention of the sealing gasket thereto.

The lid 3 has two annular ribs 90 and 91 for bearing against the tops of the lips 82 and 83 when the box is closed.

In all of the examples described, the cup containing the supply of substance is advantageously filled separately and then mounted in the body of the box.

Although in the examples described the sealing member is secured to the cup which houses the supply of substance, it would not go beyond the ambit of the invention to secure the sealing member to any other support part fitted to the lid or to the body of the box.

Figure 12:
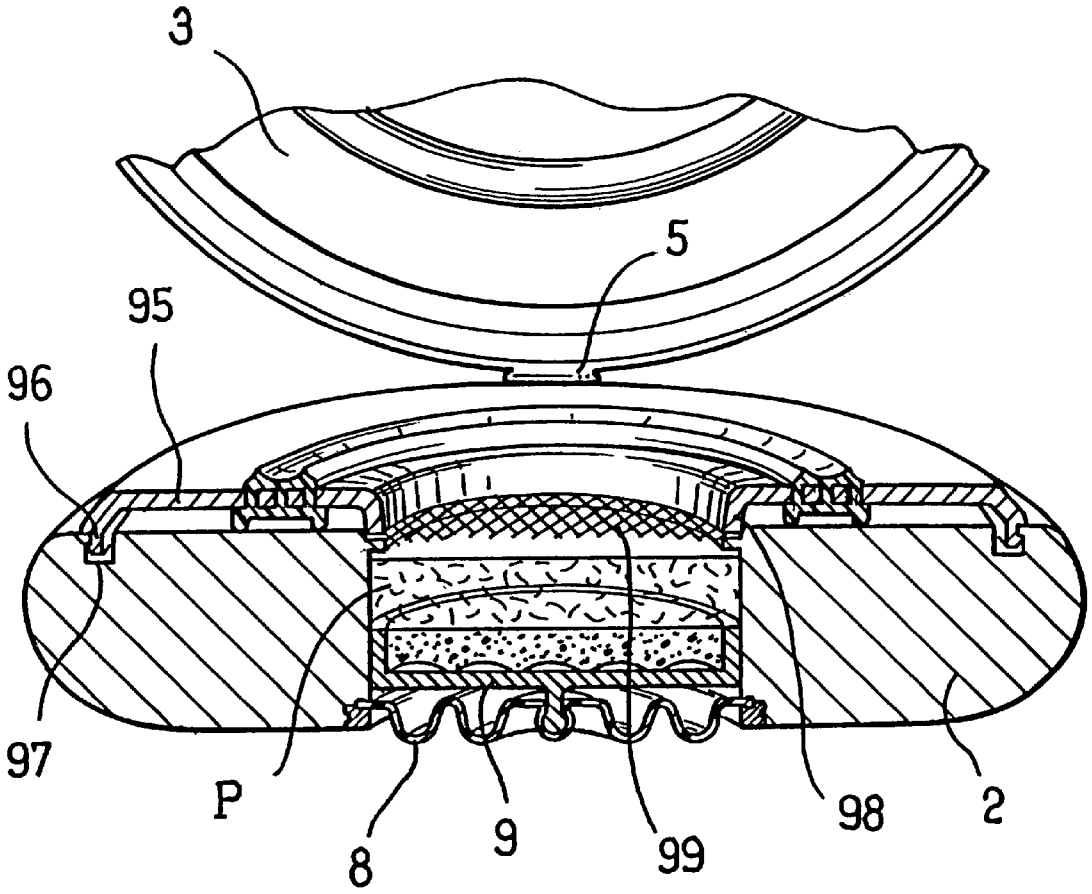
FIG. 12 shows a makeup box constituting another embodiment of the invention.

By way of example, FIG. 12 shows an embodiment in which the sealing member is secured to a mask 95 of rigid plastics material which is itself fixed to the body of the box.

More precisely, in the example described, the mask 95 serves to keep a screen 99 in place over the substance P.

At its periphery, the mask 95 has a rim 96 shaped to snap into a groove 97 in the body of the box.

The mask 95 is also curved at its radially inner edge to bear against the screen 99.

The sealing member may be constituted by any of the sealing members described above with reference to FIGS. 2 to 11.

By way of example, FIG. 12 shows a sealing member identical to the sealing member 30 described above with reference to FIG. 5.

The sealing member serves both to provide sealing between the mask 95 and the body 2 of the box, and to provide sealing between the mask 95 and the lid 3 when the box is closed.

It has been observed that because of the sealing between the mask and the body of the box, it is possible to prevent solvents contained in the substance P from evaporating via the clearance which exists between the mask 95 and the body 2 of the box.

Figure 13:
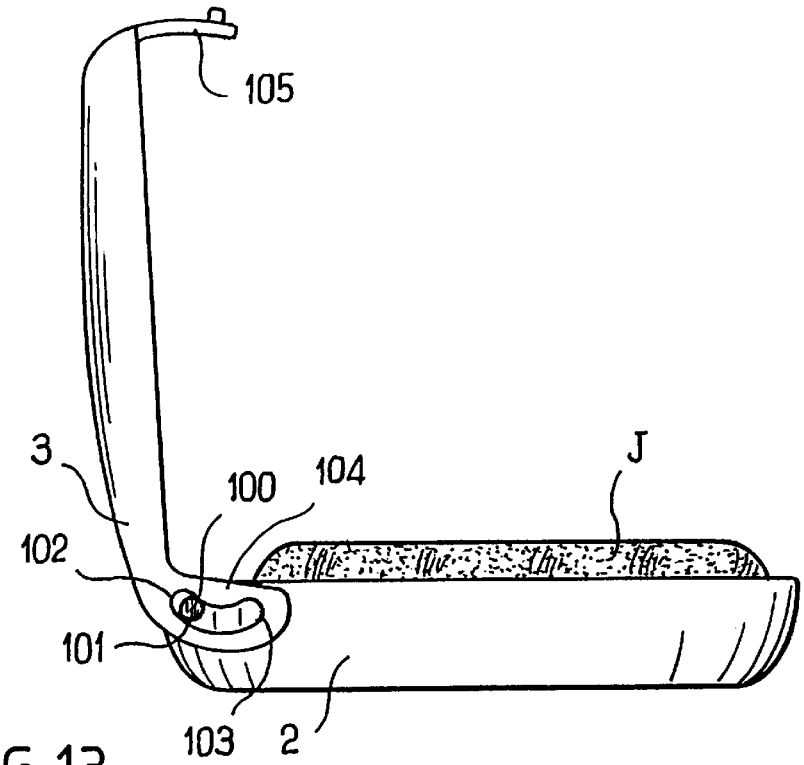
FIGS. 13 to 15 show a particular embodiment of the hinge connecting the lid to the body of the box.
Figure 14:
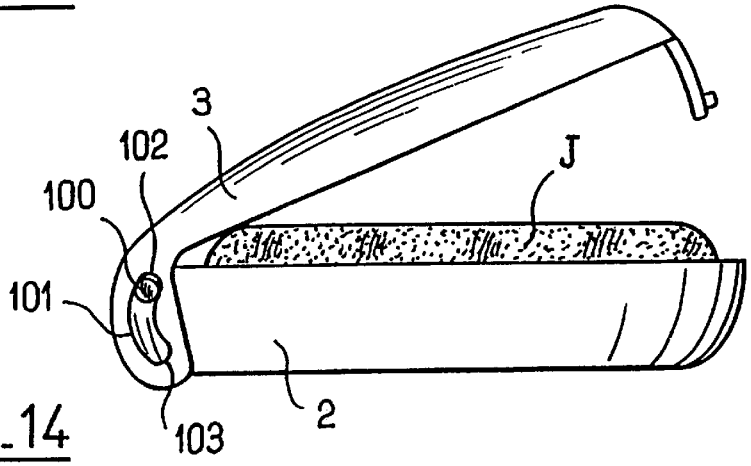
Figure 15:
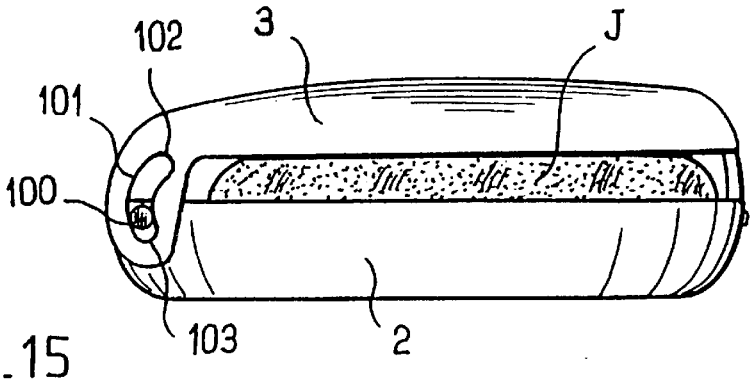

FIGS. 13 to 15 show an advantageous way of making the hinge which connects the lid to the body of the box.

Preferably, a pin 100 is used which is fixed to the body 2 of the box and whose ends project from the body to serve as pivots for the lid.

More precisely, these ends are engaged in two kidney-shaped slots 101 in the lid 3, these slots 101 being formed in sideplates 104 extending generally perpendicularly to the plane of the lid.

A clasp 105 is provided on the side remote from the hinge to hold the lid in the closed position, in conventional manner.

When the box is open, as shown in FIG. 13, each end of the pin 100 is situated in the vicinity of the ends 102 of the corresponding slot 101 which is closer to the top of the lid.

The pin 100 remains in the same position relative to the slots 101 during the initial stages of closing the lid, until the lid begins to bear against the sealing member J, as shown in FIG. 14.

The sealing member J may be any of the above-described sealing members, and it is shown in very diagrammatic manner in FIGS. 13 to 15.

When the lid 3 bears against the sealing member J, rotation of the lid is accompanied by the pin 100 sliding along the slots 101 towards the ends 103 that are further from the top of the lid, such that the lid bears in substantially uniform manner against the sealing member J.

What is claimed is:

1. A makeup box or the like comprising a body housing, a supply of substance, a lid, and a sealing member including a deformable lip extending around the supply of substance, the lid bearing against said sealing member when the box is closed, wherein the sealing member is secured to a support part mounted on the body of the and extending at least in part beneath said deformable lip.

2. A box according to claim 1, wherein said support part forms a portion of a cup designed to contain said supply of substance.

3. A box according to claim 1, wherein said support part is in the form of an annular flange.

4. A box according to claim 1, wherein said support part is constituted by a mask fixed on the body of the box.

5. A box according to claim 4, wherein said mask serves to hold in the body of the box a cup housing a supply of substance, or serves to hold a screen through which the substance is dispensed.

6. A box according to claim 1, wherein the sealing member is overmolded onto said support part or is made by dual injection with said part.

7. A box according to claim 1, wherein said support part has openings and wherein said sealing member comprises a top portion and a bottom portion interconnected through said openings, said bottom portion extending beneath said support part and bearing against the body of the box.

8. A box according to claim 7, wherein said bottom portion is annular in shape and bears in sealed manner against the body of the box.

9. A box according to claim 1, wherein the sealing member has two concentric annular sealing lips suitable for bearing in sealed manner against the lid.

10. A box according to claim 9, wherein each of said annular sealing lips is generally semicircular in section with the concave side thereof facing towards said support part.

11. A box according to claim 1, wherein one of the lid and the body of the box has at least one kidney-shaped slot, and wherein the other one of the body and the lid has a hinge pin engaged in said slot, said slot and said hinge pin being organized so that when the lid is closed, the hinge pin can move in said slot so that the lid bears against the sealing member in substantially uniform manner.

12. A make-up box or the like comprising a body housing, a supply of sub lid, and a sealing member including a deformable lip extending around the supply of substance, the lid bearing against said sealing member when the box is closed, wherein the sealing member is secured to a support part mounted on the body of the box and extending at least in part beneath said deformable lip, said support part holding a cup housing a supply of substance in the body of the box, or serving to hold a screen through which the substance is dispensed.

13. A make-up box or the like comprising a body housing, a supply of substance, a lid, and a sealing member including a deformable lip, one of the lid and the body of the box bearing against said sealing member when the box is closed, wherein the sealing member is secured to a support part mounted on the other one of the body of the box and the lid and extending at least in part beneath said deformable lip, wherein said sealing member has two concentric annular sealing lips, suitable for bearing the sealed member against the lid and wherein each of said annular sealing lips is generally semi-circular in section with the concave side thereof facing toward said support part.

14. A make-up box or the like comprising a body housing, a supply of substance, a lid, and a sealing member including a deformable lip, one of the lid and the body bearing against said sealing member when the box is closed, wherein the sealing member is secured to a support part mounted on the other one of the body of the box and the lid, and extending at least in part beneath said deformable sealing lip, wherein said sealing member is over molded onto said support part or is made by dual injection with said part.

15. A make-up box or the like comprising a body housing, a supply of substance, a lid, and sealing member including a deformable lip, the body bearing against said sealing member when the box is closed, wherein the sealing member is secured to a support part mounted on the lid and extending at least in part beneath said deformable sealing lip, wherein said support part has openings and said sealing member has a top portion and a bottom portion interconnected through said openings.

* * * * *

UNITED STATES PATENT AND TRADEMARK OFFICE

CERTIFICATE OF CORRECTION

PATENT NO. : 6,186,152 B1
DATED : February 13, 2001
INVENTOR(S) : Jean-Louis Gueret It is certified that error appears in the above-identified patent and that said Letters Patent is hereby corrected as shown below:

Column 6,
Line 10, after "housing" delete --,--;
Line 15, after "on the body of the" insert -- box --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*